US010166544B2

(12) United States Patent
Beyl et al.

(10) Patent No.: US 10,166,544 B2
(45) Date of Patent: Jan. 1, 2019

(54) UNIT FOR MAKING AVAILABLE A FLUID FOR A BIOCHEMICAL ANALYSIS DEVICE, AND METHOD AND DEVICE FOR PRODUCING SUCH A UNIT

(71) Applicant: Robert Bosch GmbH, Stuttgart (DE)

(72) Inventors: Yvonne Beyl, Zaberfeld (DE); Daniel Czurratis, Korntal-Muenchingen (DE); Sven Zinober, Friolzheim (DE)

(73) Assignee: Robert Bosch GmbH, Stuttgart (DE)

( * ) Notice: Subject to any disclaimer, the term of this patent is extended or adjusted under 35 U.S.C. 154(b) by 118 days.

(21) Appl. No.: 15/118,012

(22) PCT Filed: Jan. 21, 2015

(86) PCT No.: PCT/EP2015/051096

§ 371 (c)(1),
(2) Date: Aug. 10, 2016

(87) PCT Pub. No.: WO2015/121034

PCT Pub. Date: Aug. 20, 2015

(65) Prior Publication Data

US 2017/0014825 A1 Jan. 19, 2017

(30) Foreign Application Priority Data

Feb. 13, 2014 (DE) ..... 10 2014 202 590

(51) Int. Cl.
*B01L 99/00* (2010.01)
*B01L 3/00* (2006.01)

(52) U.S. Cl.
CPC ..... *B01L 3/523* (2013.01); *B01L 3/502* (2013.01); *B01L 3/502715* (2013.01);
(Continued)

(58) Field of Classification Search
CPC ..... B01L 2400/0481; B01L 2400/0683
See application file for complete search history.

(56) References Cited

U.S. PATENT DOCUMENTS 4,647,541 A 3/1987 Guadagno et al.
9,963,273 B2 * 5/2018 Hortig ..... B01L 3/502715
(Continued)

FOREIGN PATENT DOCUMENTS

CN 1974751 A 6/2007
CN 1977165 A 6/2007
(Continued)

OTHER PUBLICATIONS

International Search Report corresponding to PCT Application No. PCT/EP2015/051096, dated Mar. 30, 2015 (German and English language document) (5 pages).

*Primary Examiner* — Paul S Hyun
(74) *Attorney, Agent, or Firm* — Maginot, Moore & Beck LLP

(57) ABSTRACT

A unit for making available a fluid for a biochemical analysis device includes a lid element and a bottom element with a bottom recess lying opposite the lid element. A film is arranged between the lid element and the bottom element. A fluid bag with a force introduction surface for introducing a force into the fluid bag is folded and/or arranged in the bottom recess such that, without pressure acting on the film, the force introduction surface and a main plane of the film are oriented in different directions. The film is pressed against the force introduction surface when pressure acts on the film in the direction of the bottom recess to thereby introduce the force into the fluid bag. The fluid bag has at least one closure seam that opens when the force is introduced.

19 Claims, 7 Drawing Sheets

(52) U.S. Cl.
CPC ..... *B01L 3/502746* (2013.01); *B01L 3/527* (2013.01); *B01L 2200/027* (2013.01); *B01L 2200/0689* (2013.01); *B01L 2200/12* (2013.01); *B01L 2200/16* (2013.01); *B01L 2300/041* (2013.01); *B01L 2300/047* (2013.01); *B01L 2300/087* (2013.01); *B01L 2300/0816* (2013.01); *B01L 2300/123* (2013.01); *B01L 2300/14* (2013.01); *B01L 2400/0481* (2013.01); *B01L 2400/0683* (2013.01)

(56) References Cited

U.S. PATENT DOCUMENTS

| | | | | |
|---|---|---|---|---|
| 2006/0275852 | A1 | 12/2006 | Montagu et al. | |
| 2016/0038938 | A1* | 2/2016 | Chen ..... | B01L 3/502715 436/180 |

FOREIGN PATENT DOCUMENTS

| | | | |
|---|---|---|---|
| CN | 101262948 | A | 9/2008 |
| CN | 101657260 | A | 2/2010 |
| CN | 101688860 | A | 3/2010 |
| CN | 101738484 | A | 6/2010 |
| DE | 10 2012 222 719 | A1 | 6/2014 |
| EP | 2 186 563 | A2 | 5/2010 |

* cited by examiner

UNIT FOR MAKING AVAILABLE A FLUID FOR A BIOCHEMICAL ANALYSIS DEVICE, AND METHOD AND DEVICE FOR PRODUCING SUCH A UNIT

This application is a 35 U.S.C. § 371 National Stage Application of PCT/EP2015/051096, filed on Jan. 21, 2015, which claims the benefit of priority to Serial No. DE 10 2014 202 590.7, filed on Feb. 13, 2014 in Germany, the disclosures of which are incorporated herein by reference in their entireties.

BACKGROUND

The present disclosure relates to a unit for making available a fluid for a biochemical analysis device, to a method for producing such a unit, to a corresponding device, and to a corresponding computer program product.

Largely irrespective of their chemical nature, reagents can be stored for many years in a lab-on-a-chip system (LOC) without any appreciable losses of liquid and can be released in a controlled manner, for example by means of a pneumatic control. In contrast to direct storage in plastic chambers, this concept of long-term, stable storage of reagents and their release may require a large surface area.

SUMMARY

Against this background, the approach presented here proposes a unit for making available a fluid for a biochemical analysis device, a method for producing such a unit, also a device using this method, a corresponding computer program and, finally, a corresponding storage medium according to the following description. Advantageous embodiments are set forth in the following description.

The present approach provides a unit for making available a fluid for a biochemical analysis device, wherein the unit has the following features:

a lid element;

a bottom element with at least one bottom recess, wherein the bottom recess is arranged lying opposite the lid element;

a film which, at least in the area of the bottom recess, is arranged between the lid element and the bottom element; and at least one fluid bag with a force introduction surface for introducing a force into the fluid bag, wherein the fluid bag is arranged folded in the bottom recess and/or is arranged in the bottom recess in such a way that, in a rest state of the film, without pressure acting on the film, the force introduction surface and a main plane of extent of the film are oriented in different directions, wherein the film is designed to be pressed against the force introduction surface when pressure acts on the film in the direction of the bottom recess, so as to introduce the force into the fluid bag, and wherein the fluid bag has at least one closure seam, which is designed to open when the force is introduced.

A fluid can be understood, for example, as a liquid with a reagent for carrying out a biochemical reaction. A biochemical analysis device can be understood, for instance, as a microfluidic system which is designed to use the fluid in order to analyze a biochemical material. The unit can comprise a lid element and also a bottom element with a bottom recess. The lid element and the bottom element can be embodied, for example, as layers of a layered composite. A film can be understood as an elastically deformable membrane. The film can, for example, be produced from a polymer. A fluid bag can be understood as a fluid-tight, foldable tube for storage of the fluid. The fluid bag can, for instance, have a rectangular, flat shape. For example, the fluid bag can be produced from a thin film of metal or plastic. The fluid bag can be closed in a fluid-tight manner by at least one closure seam. The closure seam can be a sealing seam, for example, also called a peel seam. The closure seam can be designed to be opened by means of a force introduced into the fluid bag. In order to introduce the force into the fluid bag, the fluid bag can have a force introduction surface. A force introduction surface can be understood as a surface of the fluid bag to which a pressure can be applied in order to increase an internal pressure of the fluid bag.

The present approach is based on the recognition that it is possible to considerably reduce the space required by a microfluidic system for carrying out a biochemical reaction and to do so by means of a folded tubular bag, which is filled with a suitable reagent, being arranged in the system. Alternatively or in addition, the space requirement can be reduced if a main plane of extent of the tubular bag and a main plane of extent of the film are arranged inclined with respect to each other.

In one embodiment of the present approach, a lab-on-a-chip system is provided for storing reagents in tubular bags with reduced space requirements. Particularly in analysis methods that require a large number of reagents, for example methods for diagnosis of bacterial infections, for example sepsis, a lab-on-a-chip cartridge can thus be produced in a size that is easily manageable for an end user.

According to one embodiment of the approach presented here, the fluid bag can have at least one predetermined fold location for folding the fluid bag. In particular, the fold location can in this case be embodied at least partially by a sealing seam. A predetermined fold location can be understood as a predetermined bending point. A sealing seam can be understood as a connection seam, generated by means of heat and pressure, between two superposed films of the fluid bag. Folding of the film bag can be made easier with the aid of the fold location. Moreover, this ensures that the film bag is folded at a defined location. By means of the sealing seam, the film bag can be very easily divided into two chambers, for example in order to store different fluids in the fluid bag.

Advantageously, the fluid bag can have the fold location at least partially along a plane of symmetry and/or an axis of symmetry of the fluid bag. In this way, it is possible to obtain a particularly compact form of the film bag in the folded state.

Moreover, the unit can be provided with a fixing element, which is designed to fix the film in the area of the bottom recess at least partially on the lid element. A fixing element can be understood, for example, as an adhesion layer which is formed between the lid element and the film in order to bond the film to the lid element. Alternatively or in addition to adhesive bonding, laser welding or hot pressing is also possible. The fixing element can reliably prevent the film bag from being pressed shut by the film in the area of the closure seam when the pressure is conveyed into the bottom recess.

According to a further embodiment of the approach described here, the unit can comprise at least one collection chamber, which is formed in the lid element and/or the bottom element, in order to collect the fluid when the closure seam opens. The collection chamber can be embodied as a separate chamber of the unit or also as part of the bottom recess. By means of the collection chamber, the fluid can be transferred in a controlled manner when the closure seam opens.

Moreover, the unit can be provided with at least one channel, which is formed in the lid element and/or the bottom element in order to fluidically connect the bottom recess and the collection chamber to each other. In particular, the collection chamber can in this case have an outlet for conveying the fluid between the collection chamber and the analysis device. The outlet can open into the analysis device. In this way, when the closure seam opens, the fluid can be transported in a controlled manner from the bottom recess into the analysis device.

The force introduction surface can comprise a stabilizing element. The film can in this case be designed to be pressed against the stabilizing element when the pressure is conveyed into the bottom recess, so as to introduce the force into the fluid bag. A stabilizing element can be understood, for example, as an intermediate plate made of a hard material and arranged between the film bag and the film. By means of the stabilizing element, it is possible to ensure a uniform distribution of the pressure along the force introduction surface when the pressure is conveyed into the bottom recess.

In addition, at least one further fluid bag can be provided, with a further force introduction surface for introducing a further force into the further fluid bag.

In this case, the further fluid bag can be arranged folded in the bottom recess. Alternatively or in addition, the further film bag can be arranged in the bottom recess in such a way that, in the rest state of the film, the further force introduction surface and the main plane of extent of the film are oriented in different directions. The film can be designed to be pressed moreover against the further force introduction surface by a pressure when said pressure is conveyed into the bottom recess, so as to introduce the further force into the further fluid bag. The further fluid bag can have at least one further closure seam, which is designed to open when the further force is introduced. By virtue of this embodiment of the approach presented here, it is possible to save space by storing a plurality of reagents in one and the same bottom recess.

The unit can be made particularly compact if the force introduction surface and the further force introduction surface according to a further embodiment are arranged lying opposite each other. Alternatively or in addition, the force introduction surface and the further force introduction surface can each be arranged at an acute angle and/or right angle to the main plane of extent of the film. An acute angle can be understood as an angle of less than 90 degrees.

The present approach additionally provides a method for producing a unit according to one of the embodiments described above, wherein the method comprises the following steps:

making available a lid element, a bottom element with at least one bottom recess, a film, and at least one fluid bag with a force introduction surface for introducing a force into the fluid bag; and forming a composite of the lid element, the bottom element, the film and the fluid bag, wherein the bottom recess is arranged lying opposite the lid element, wherein the film, at least in the area of the bottom recess, is arranged between the lid element and the bottom element, wherein the fluid bag is arranged folded in the bottom recess and/or is arranged in the bottom recess in such a way that, in a rest state of the film, the force introduction surface and a main plane of extent of the film are oriented in different directions, wherein the film is designed to be pressed against the force introduction surface by a pressure when said pressure is conveyed into the bottom recess, so as to introduce the force into the fluid bag, and wherein the fluid bag has at least one closure seam, which is designed to open when the force is introduced.

The approach presented here moreover provides a device which is designed to perform or implement the steps of a variant of a method presented here in corresponding means. This design variant of the disclosure in the form of a device also allows the object of the disclosure to be achieved quickly and efficiently.

A device here can be understood as an electrical appliance which processes sensor signals and, in accordance with the latter, outputs control signals and/or data signals. The device can have an interface which can take the form of hardware and/or software. In the case of hardware, the interfaces can, for example, be part of what is called an ASIC system, which contains a wide variety of functions of the device. However, it is also possible that the interfaces are dedicated integrated circuits or at least partially consist of discrete components. In the case of software, the interfaces can be software modules, which are for example present on a microcontroller along with other software modules.

Also of advantage is a computer program product with a program code, which can be stored on a machine-readable carrier such as a semiconductor memory, a hard drive memory or an optical storage medium and is used for carrying out and/or activating the steps of the method according to one of the embodiments described above, in particular when the program product is run on a computer or a device.

Finally, the present approach provides a machine-readable storage medium with a computer program stored on same according to one of the embodiments described here.

BRIEF DESCRIPTION OF THE DRAWINGS

The approach presented here is explained in more detail below with reference to the examples in the attached drawings, in which.

DETAILED DESCRIPTION

In the following description of expedient illustrative embodiments of the present disclosure, elements that are shown in the different figures and have a similar action are labeled by identical or similar reference signs, in which case a repeated description of these elements is omitted.

Figure 1:
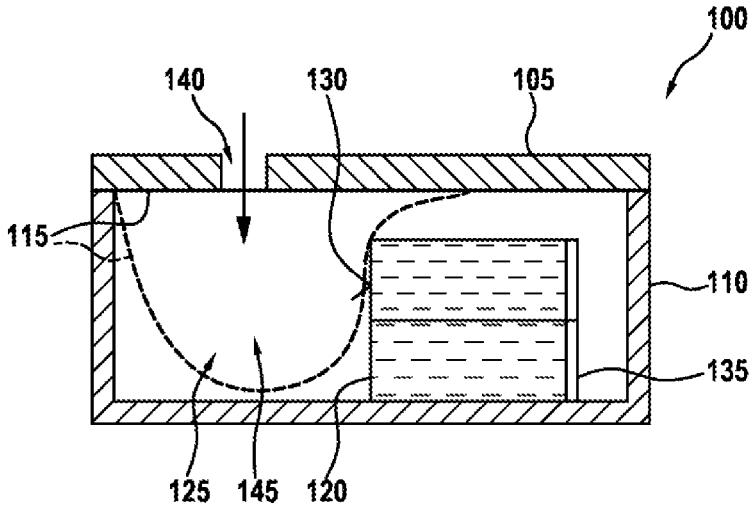
FIG. 1 shows a schematic view of a unit for making available a fluid for a biochemical analysis device according to an illustrative embodiment of the present disclosure.

FIG. 1 shows a schematic view of a unit 100 for making available a fluid for a biochemical analysis device according to an illustrative embodiment of the present disclosure. The unit 100 comprises a lid element 105, a bottom element 110, a film 115 and a fluid bag 120. The bottom element 110 is formed with a bottom recess 125, which is arranged lying opposite the lid element 105. The film 115 is arranged in the area of the bottom recess 125 between the bottom element 110 and the lid element 105. The fluid bag 120 is arranged in the bottom recess 125. The fluid bag 120 is arranged in a folded state in the bottom recess 125. Here, the fluid bag 120 is designed with a force introduction surface 130 and a closure seam 135. The force introduction surface 130 and a main plane of extent of the film 115 are oriented in different directions in an undeflected state of the film 130. According to this illustrative embodiment, the force introduction surface 130 extends perpendicularly with respect to the main plane of extent of the film 115. Here, the force introduction surface 130 is formed in a first end area of the fluid bag 120. The closure seam 135 extends along a second end area of the fluid bag 120 lying opposite the first end area.

The lid element 105 has an opening 140 in the area of the bottom recess 125. The opening 140 is designed as a compressed air delivery and can for this purpose be connected to a pressure unit (not shown in FIG. 1) for applying a pressure to the opening 140. For example, the opening 140 is part of a channel (not shown) that can be connected to the pressure unit.

The opening 140 is designed to apply the pressure to a side of the film 115 directed away from the bottom recess 125. Thus, the film 115 is deflected in the direction of the bottom recess 125 and pressed against the force introduction surface 130, in order to introduce a force into the fluid bag 120. In this way, an internal pressure of the fluid bag 120 increases.

The closure seam 135 is designed to be torn open when the internal pressure increases. The fluid is then forced out of the fluid bag 120 by the pressure applied by the film 115. An example of a deflected state of the film 115 is indicated by a broken line.

According to this illustrative embodiment, the opening 140 is laterally offset with respect to the force introduction surface 130, with the result that, between the opening 140 and a bottom surface of the bottom recess 125 lying opposite the opening 140, a deflection area 145 is provided which, upon application of the pressure at the opening 140, permits a controlled deflection of the film 115 against the force introduction surface 130, so as to introduce the force into the fluid bag 120.

By means of the unit 100, which is designed as a cartridge for example, a method for making available a fluid for a biochemical analysis device can be optimized, in terms of surface area requirement, by the fact that reagent numbers for more complex analysis assays can also be made available without increasing a form factor of the cartridge 100. The cartridge 100 in this case permits the use of a diffusion-tight stick pack technology and a pneumatic release of the fluid.

Thus, for example, a cartridge depth can be better utilized. As a result of the way in which samples are introduced, for example cell material from smears, blood, sputum or excretions, the cartridge depth is generally greater than would be necessary for storage of reagents. According to an illustrative embodiment of the disclosure described here, this location at depth can be efficiently utilized in favor of a cartridge surface area, i.e. the cartridge surface area can be reduced without, for example, a three-layer cartridge structure being modified in principle. Here, two design types are to be distinguished: on the one hand, folded stick packs 120, and, on the other hand, stick packs 120 inserted on end, also called fluid bags or tube bags. Subvariants may exist for both types.

Figure 2A:
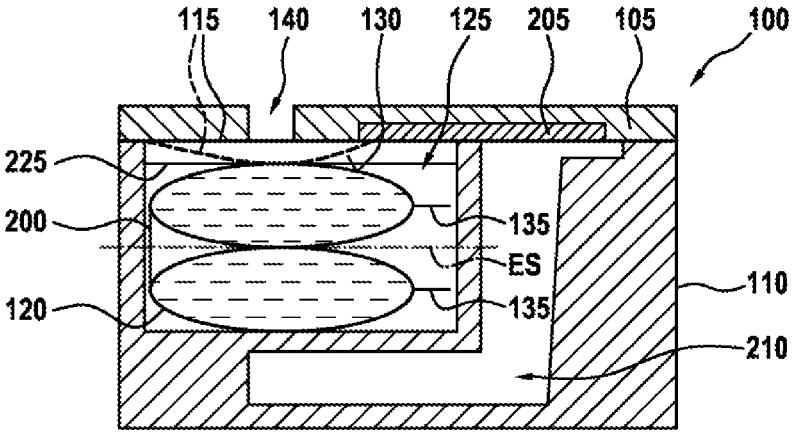
FIGS. 2*a* and 2*b* show schematic views of a unit for making available a fluid, with a folded fluid bag, according to an illustrative embodiment of the present disclosure.
Figure 2B:
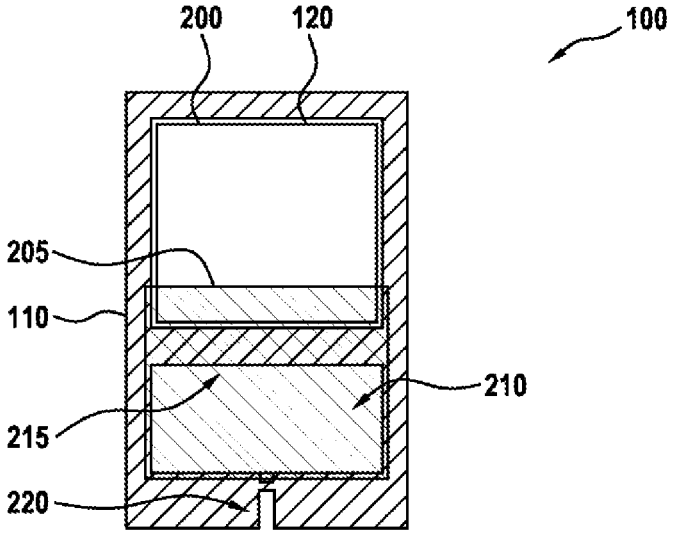

FIGS. 2*a* and 2*b* show schematic views of a unit 100 for making available a fluid, with a folded fluid bag 120, according to an illustrative embodiment of the present disclosure. FIG. 2*a* shows a schematic cross-sectional view of the unit 100. FIG. 2*b* shows a schematic plan view of the unit 100 without lid element 105 and without film 115.

In contrast to FIG. 1, the fluid bag 120 shown in FIGS. 2*a* and 2*b* has a fold location 200. According to this illustrative embodiment, the fold location 200 is designed to fold the fluid bag 120, at a middle of the fluid bag 120, about a plane of symmetry ES which, in FIGS. 2*a* and 2*b*, extends transversely, for example, with respect to a longitudinal axis of the fluid bag 120.

The fold location 200 is optionally embodied by a sealing seam, in order to divide the fluid bag 120 into two fluid chambers by means of the fold location 200. Here, an opening can be formed in the fold location 200 and serves to connect the two fluid chambers fluidically to each other.

In the undeflected state of the film 115, the force introduction surface 130 and the film 115 are arranged lying opposite each other and substantially parallel to each other. Moreover, in contrast to FIG. 1, the force introduction surface 130 is arranged lying opposite the opening 140.

The fluid bag 120 comprises, for example, a film tube, of which the opposite tube openings are each closed in a fluid-tight manner by means of the closure seam 135. The fluid bag 120 is folded together in such a way that the closure seams 135 point in the same direction and the fold location 200 is arranged lying opposite the closure seams 135. Thus, when the force is introduced into the fluid bag 120, the two closure seams 135 can be opened simultaneously, so as to make available the fluid located in the fluid bag 120. It is also possible that, by introduction of force, the sealing seam of the fold location 200 opens and then the fluid bag 120 is emptied via only one closure seam 135. The other closure seam 135 then remains closed.

The unit 100 comprises a fixing element 205 which is formed, for example, as an adhesive layer or connection seam between the lid element 105 and the film 115, so as to fix the film 115 on the lid element 105. Here, the fixing element 205 extends across that area of the bottom recess 125 in which the closure seams 135 are arranged. This ensures that, when the pressure is applied at the opening 140, the closure seams 135 are not pressed shut by a deflection of the film 115.

Moreover, a collection chamber 210 is formed in the bottom element 110. The collection chamber 210 is designed as a further bottom recess in the bottom element 110, wherein the further bottom recess, like the bottom recess 125, is arranged lying opposite the lid element 105. The collection chamber 210 extends partially around the bottom recess 125. The collection chamber 210 is designed to collect the fluid when the closure seams 135 open.

In order to connect the bottom recess 125 and the collection chamber 210 fluidically to each other, a channel 215 is formed between the lid element 105 and the bottom element 110, as is shown in FIG. 2*b*. The collection chamber 210 moreover has an outlet 220 in the form of a further channel formed between the lid element 105 and the bottom element 110. The outlet 220 serves to convey the fluid from the collection chamber 210 to the biochemical analysis device (not shown). The bottom element 110 can also be designated as a fluidics plane of the unit 100.

FIG. 2*b* also shows that the collection chamber 210 is completely covered by the fixing element 205.

According to a further illustrative embodiment of the present disclosure, a stabilizing element 225 in the form of an intermediate plate is arranged between the force introduction surface 130 and the film 115. The stabilizing plate 225 is designed such that, when the pressure is applied at the opening 140, it permits a uniform application of the pressure to the force introduction surface 130.

In a variant of the present disclosure, provision is made that the stick packs 120 are folded in the middle and inserted into a corresponding chamber 125. In this way, the required space can be reduced by over 40 percent, for example, in relation to customary units for making fluid available. For simple handling during production, a predetermined bending point 200 can be embossed by suitable means, for example by thermal sealing analogously to the production of stick-pack seams. The sealing can be complete such that a two-chamber bag 120 is obtained, or it can also be partial, such that an exchange of liquid between both partial chambers is permitted via a channel.

A start and end seam 135 of the stick pack 120 can be designed as a transverse seam with one or two peel seams. Two-chamber bags 120 are expediently designed with two peel seams. Bags 120 with chambers connected via a connection channel advantageously have at least one peel seam.

FIGS. 2*a* and 2*b* show a possible design of twin-chamber stick packs 120. Here, a folded stick pack 120 is inserted into the cartridge 100 preferably such that the force introduction surface 130 of the stick pack 120 is arranged parallel to the undeflected membrane 115. In some areas, the membrane 115 is fixed to a pneumatics plane 105, also called lid element 105. The membrane 115 cannot deflect in these areas when compressed air is applied. It is thus possible, in particular, to avoid a situation where the membrane 115, upon deflection, presses the closure seam 135 shut and thus prevents opening of the closure seam 135, designed for example as a peel seam.

A supply chamber 210 for transfer of the stick pack content is arranged, for example, in front of and/or under the stick pack 120. The supply chamber 210 can also be designated as a collection chamber.

Alternatively or in addition, a volume of the supply chamber 210, produced by a support structure of columns, is integrated directly into a stick pack chamber 125.

An introduction of force through the membrane 115 can be improved via an intermediate plate 225 between the membrane 115 and the stick pack 120.

Figure 3A:
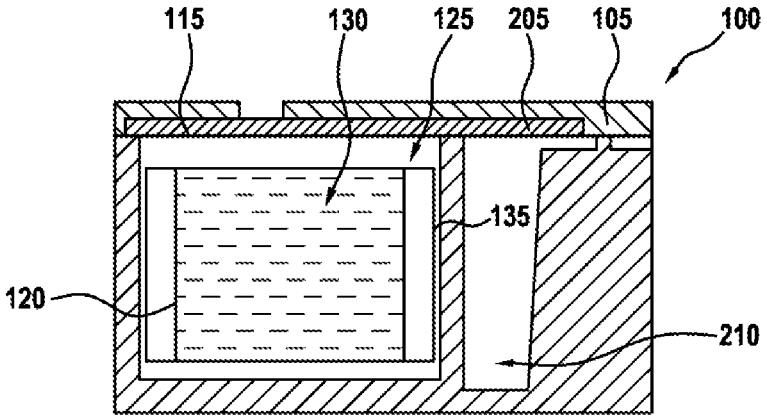
FIGS. 3*a*, 3*b* and 3*c* show schematic views of a unit for making available a fluid, with a fluid bag inserted on end, according to an illustrative embodiment of the present disclosure.
Figure 3B:
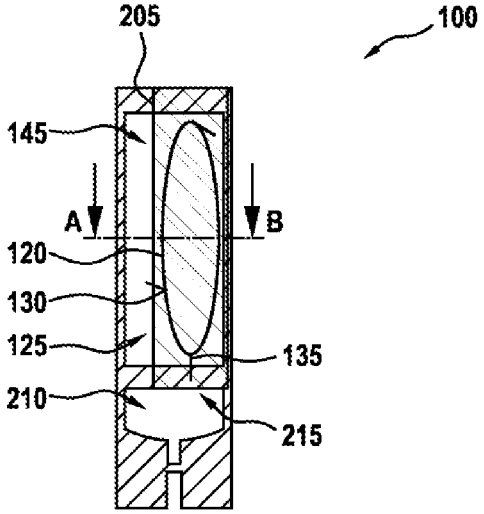
Figure 3C:
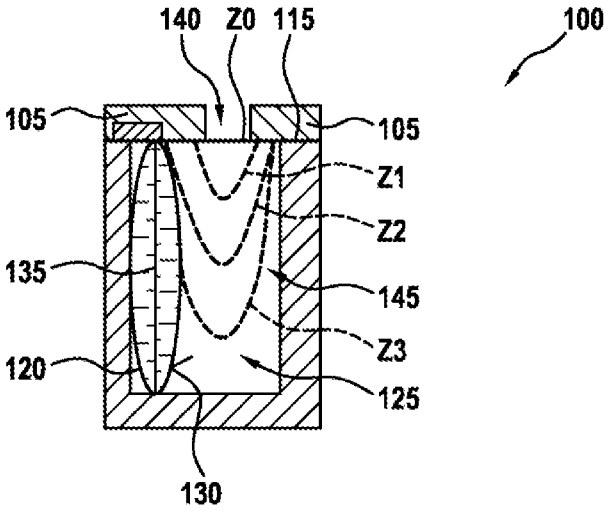

FIGS. 3*a*, 3*b* and 3*c* show schematic views of a unit 100 for making available a fluid, with a fluid bag 120 inserted on end, according to an illustrative embodiment of the present disclosure. FIG. 3*a* shows a schematic cross-sectional view of the unit 100. FIG. 3*b* shows a plan view of the unit 100. FIG. 3*c* shows a cross section of the unit 100 along a straight line AB which is shown in FIG. 3*b* and which substantially corresponds to a transverse axis of the fluid bag 120. In contrast to FIGS. 2*a* to 2*c*, the fluid bag 120 shown in FIGS. 3*a* to 3*c* is arranged in an unfolded state in the bottom recess 125. Here, the fluid bag 120 has a rectangular, flat shape and is arranged on end in the bottom recess 125, i.e. the force introduction surface 130, in the undeflected state of the film 115, extends perpendicularly with respect to the main plane of extent of the film 115, similarly to what has already been described with reference to FIG. 1.

The fluid bag 120 is arranged adjoining a side wall of the bottom recess 125, wherein the force introduction surface 130 is directed away from the side wall. Here, the force introduction surface 130 extends along a longitudinal axis of the unit 100. An area of the bottom recess 125 adjoining the force introduction surface 130 is designed as a deflection area 145 for the film 115.

The fixing element 205 covers a first half of the bottom recess 125, in which half the fluid bag 120 is arranged. The fluid bag 120 is thus covered for the most part by the fixing element 205. A second half of the bottom recess 125, which half forms the deflection area 145, is not covered by the fixing element 205, as shown in FIG. 3*b*.

The closure seam 135 points in the direction of the collection chamber 210 which, in contrast to FIG. 2*a*, extends for the most part along only one side of the bottom recess 125. Moreover, the closure seam 135 reaches partially into the channel 215, as shown in FIG. 3*b*.

The unit 100 shown in FIG. 3*b* is also considerably narrower than the unit 100 shown in FIG. 2*b*.

FIG. 3*c* shows three different deflection states Z1, Z2 and Z3 of the film 115, in each case in broken lines. When the pressure is applied at the opening 140, the film 115 bulges into the deflection area 145. In a rest state Z0, the film 115 extends perpendicularly with respect to the force introduction surface 130. In a first deflection state Z1 and a second deflection state Z2, the film 115 still has no contact with the force introduction surface 130. In a third deflection state Z3, the film 115 reaches so far into the bottom recess 125 that a partial segment of the film 115 is pressed against the force introduction surface 130, so as to open the closure seam 135. By means of the fixing element 205, the deflection of the film 115 is limited substantially to the deflection area 145.

According to an illustrative embodiment of the present disclosure, a surface normal of the sealing seam 135 forms an angle different than 0 degree with a surface normal of the membrane plane. In FIG. 3*c*, the stick pack 120 is, for example, inserted on end into the chamber 125. The stick pack 120 can in particular be arranged in the chamber 125 in such a way that the surface normal of the sealing seam 135 forms an angle in the range of 30 to 60 degrees with a surface normal of the membrane plane.

FIGS. 3*a* and 3*b* show a design for a stick pack 120 inserted on end. FIG. 3*c* shows different deflection states Z1, Z2 and Z3 of the membrane 115 in a perpendicular chamber 125 and illustrates a transfer of force from the membrane 115 to a side surface 130 of the stick pack 120.

To allow the membrane 115 to empty the stick pack 120, an expansion volume 145 is provided as deflection area alongside the stick pack 120. Thus, an overall width composed of stick pack chamber 125 and expansion chamber 145 is clearly below a width of previous design concepts.

Fixing the membrane 115 to the pneumatics plane 105 has the effect that a force from the membrane 115 acts laterally on the stick pack 120, so as to favor opening of the peel seam 135.

Figure 4A:
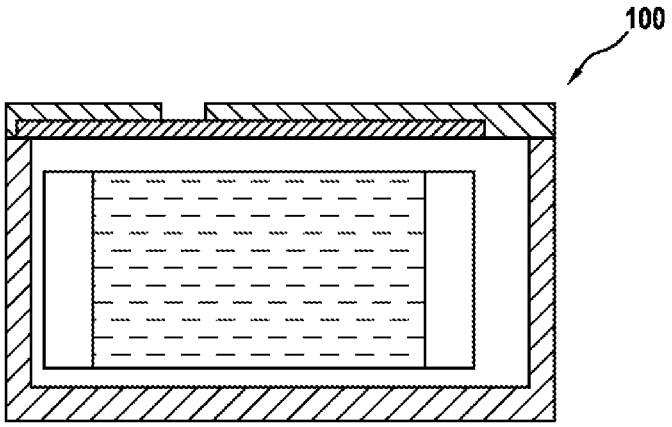
FIGS. 4*a*, 4*b*, 4*c* and 4*d* show schematic views of a unit for making available a fluid, with a fluid bag and a further fluid bag, according to an illustrative embodiment of the present disclosure.
Figure 4B:
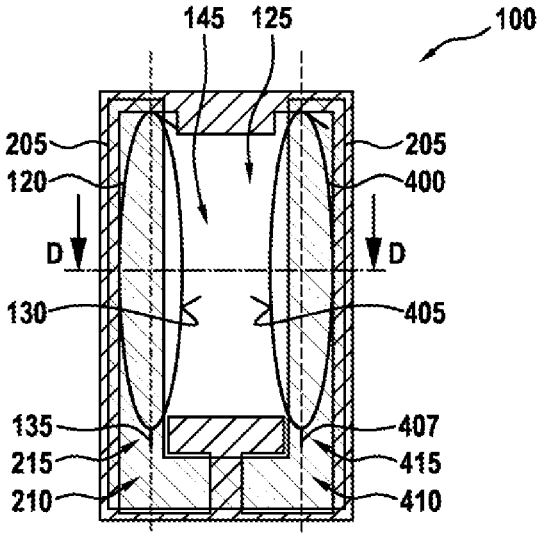
Figure 4C:
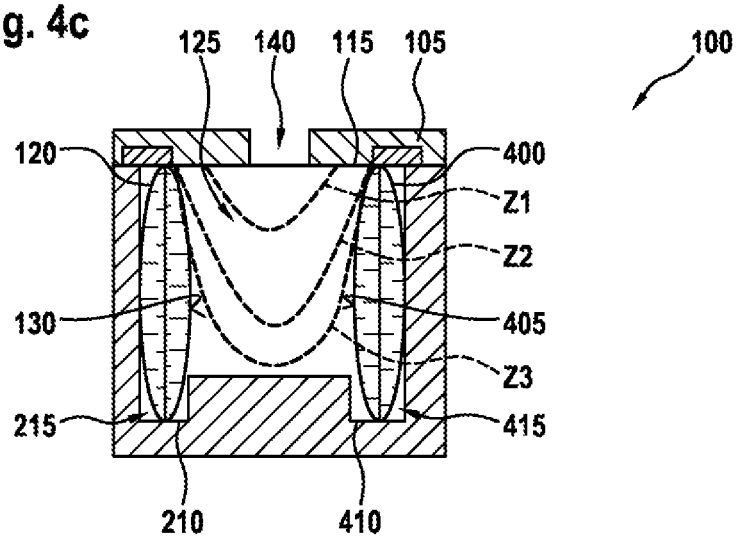
Figure 4D:
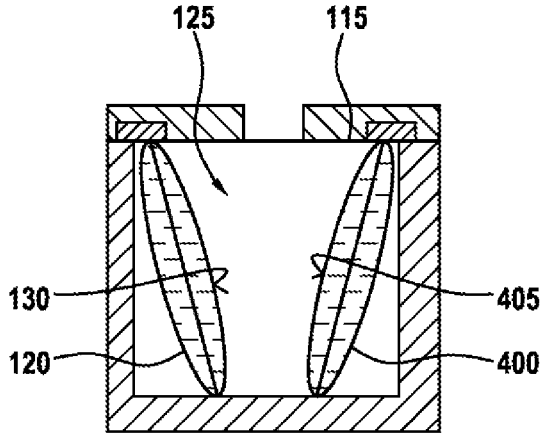

FIGS. 4*a*, 4*b*, 4*c* and 4*d* show schematic views of a unit 100 for making available a fluid, with a fluid bag 120 and a further fluid bag 400, according to an illustrative embodiment of the present disclosure. FIG. 4*a* shows a schematic cross-sectional view of the unit 100, FIG. 4*b* shows a plan view of the unit 100, and FIGS. 4*c* and 4*d* show a cross section of the unit 100 along a straight line CD which is indicated in FIG. 4*b* and which corresponds substantially to a respective transverse axis of the fluid bags 120, 400. As has already been described with reference to FIGS. 3*a* to 3*c*, the fluid bags 120, 400 in FIGS. 4*a* to 4*c* are arranged on end in the bottom recess 125.

As can be seen from FIG. 4*b*, the fluid bags 120, 400 are arranged adjoining mutually opposite side walls of the bottom recess 125. Here, a further force introduction surface 405 of the further fluid bag 400 is arranged lying opposite the force introduction surface 130 of the fluid bag 120. The deflection area 145 is formed between the force introduction surfaces 130, 405. Analogously to FIG. 3*b*, the fluid bags 120, 400 are for the most part covered by the fixing element 205. The further fluid bag 400 has a further closure seam 407, which is designed to open when the force is introduced into the further fluid bag 400.

The unit 100 is designed with a further collection chamber 410, which is fluidically connected, via a further channel 415, to an area of the bottom recess 125 in which the further fluid bag 400 is arranged. The further closure seam 407 reaches partially into the further channel 415. The collection chamber 210 is connected via the channel 215 to an area of the bottom recess 145 in which the fluid bag 120 is arranged.

FIG. 4*c* shows the three deflection states Z1, Z2 and Z3 of the film 115, analogously to the unit 100 shown in FIG. 3*c*. Here, when the pressure is applied at the opening 40, the film 115 is designed to bear, in the third deflection state Z3, both against the force introduction surface 130 and also against the further force introduction surface 405, so as to open the fluid bag 120 and the further fluid bag 400.

Moreover, the bottom recess 125 has two groove-shaped depressions 410 arranged parallel to each other. The fluid bags 120, 400 are placed respectively in the depressions 410. The depressions 410 are, for example, designed to stabilize the fluid bags 120, 400. Optionally, the depressions 410 perform the function of the channels 215, 415.

To achieve a better expansion behavior of the membrane 115, the bottom recess 125 is designed as a double chamber in which two stick packs 120, 400 share an expansion chamber 145. Design measures in the area of a fluid outlet, in the form of the peel seam 135, avoid mixing of liquids.

After the peel seam 135, the stick pack 120 can have a tubular continuation, which is produced such that the stick pack tube is not cut off directly at the peel seam 135 but instead alongside the latter. This effect can also be realized by corresponding formation of an insert form.

Optionally, the stick packs 120, 400 are aftersealed in order to adapt a ratio between length and width of the stick packs 120, 400.

The stick packs 120, 400 are, for example, inserted into the double chamber 125 in mirror symmetry with respect to a central axis of the double chamber 125. Here, the stick packs 120, 400 can be positioned at angles to the membrane 115 that are different than 90 degrees. It is thus possible to reduce a width of the expansion chamber 145 and reduce a stretching load of the membrane 115. Thus, two adjacent stick packs 120, 400 can be emptied by a single membrane 115, without reagents that are made available being mixed together.

FIG. 4*c* shows a section through a perpendicular double chamber 125 along a straight line CD, with various deflection states Z1, Z2 and Z3 of the membrane 115, and illustrates a transfer of force from the membrane 115 to the side surfaces of the two stick packs 120, 400.

In contrast to FIG. 4*c*, the film bags 120, 400 shown in FIG. 4*d* are not perpendicular to each other, and instead they each assume an angle of between 30 and 60 degrees with respect to the surface normal of the membrane 115. The film bags 120, 400 thus lie obliquely in the chamber 125 and form a trapezium or a triangle with the membrane 115 in the section plane shown in FIG. 4*d*.

Figure 5:
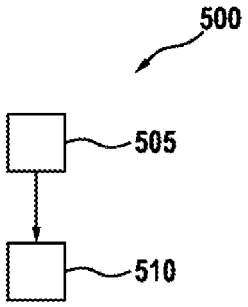
FIG. 5 shows a flow diagram of a method for producing a unit for making available a fluid according to an illustrative embodiment of the present disclosure.

FIG. 5 shows a flow diagram of a method 500 for producing a unit for making available a fluid according to an illustrative embodiment of the present disclosure. The method 500 comprises a step 505 of making available a lid element, a bottom element with at least one bottom recess, a film, and at least one fluid bag with a force introduction surface for introducing a force into the fluid bag. The method 500 moreover comprises a step 510 of forming a composite of the lid element, the bottom element, the film and the fluid bag. Here, the bottom recess is arranged lying opposite the lid element, the film, at least in the area of the bottom recess, is arranged between the lid element and the bottom element, and the fluid bag is arranged folded in the bottom recess and/or is arranged in the bottom recess in such a way that, in a rest state of the film, the force introduction surface and a main plane of extent of the film are oriented in different directions. Moreover, the film here is designed to be pressed against the force introduction surface by a pressure when said pressure is conveyed into the bottom recess, so as to introduce the force into the fluid bag. Finally, the fluid bag here has at least one closure seam, which is designed to open when the force is introduced.

Figure 6:
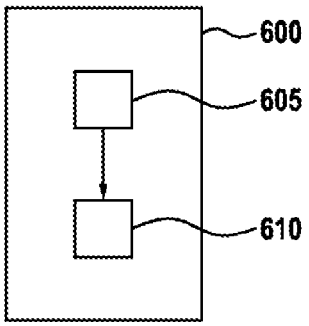
FIG. 6 shows a block diagram of a device for carrying out a method according to an illustrative embodiment of the present disclosure.

FIG. 6 shows a block diagram of a device 600 for performing a method according to an illustrative embodiment of the present disclosure. The device 600 comprises a unit 605 which is designed to make available a lid element, a bottom element with at least one bottom recess, a film, and at least one fluid bag with a force introduction surface for introducing a force into the fluid bag. A unit 610, which is designed to form a composite from the lid element, the bottom element, the film and the fluid bag, is connected to the unit 605. Here, the unit 610 is designed to arrange the bottom recess opposite the lid element, to arrange the film at least in the area of the bottom recess between the lid element and the bottom element, and to arrange the fluid bag folded in the bottom recess and/or to arrange the fluid bag in the bottom recess in such a way that, in a rest state of the film, the force introduction surface and a main plane of extent of the film are oriented in different directions. Moreover, the film here is designed to be pressed against the force introduction surface by a pressure when said pressure is conveyed into the bottom recess, so as to introduce the force into the fluid bag. Finally, the fluid bag here has at least one closure seam, which is designed to open when the force is introduced.

The illustrative embodiments that have been described and that are shown in the figures are chosen only as examples. Different illustrative embodiments can be combined with one another as a whole or in terms of individual features. An illustrative embodiment can also be supplemented by features of another illustrative embodiment.

Moreover, the method steps presented here can be repeated and can also be carried out in a different sequence than that described.

Where an illustrative embodiment comprises an "and/or" link between a first feature and a second feature, this is to be understood as meaning that the illustrative embodiment, in one form, has both the first feature and also the second feature and, in another form, has either only the first feature or only the second feature.

The invention claimed is:

1. A unit for making available a fluid for a biochemical analysis device, the unit comprising:

a lid element;

a bottom element with at least one bottom recess, wherein the at least one bottom recess is arranged lying opposite the lid element;

a film which, at least in an area of the at least one bottom recess, is arranged between the lid element and the bottom element; and at least one fluid bag with a force introduction surface via which a force is introduced into the at least one fluid bag, wherein the at least one fluid bag is arranged folded in the at least one bottom recess and/or is arranged in the at least one bottom recess in such a way that, in a rest state of the film, without pressure acting on the film, the force introduction surface and a main plane of extent of the film are oriented in different directions, wherein the film is pressed against the force introduction surface when pressure acts on the film in the direction of the at least one bottom recess, so as to introduce the force into the at least one fluid bag, and wherein the at least one fluid bag has at least one closure seam that opens when the force is introduced.

2. The unit as claimed in claim 1, wherein the at least one fluid bag is folded at at least one predetermined fold location on the at least one fluid bag.

3. The unit as claimed in claim 2, wherein the at least one predetermined fold location is defined by at least one of a plane of symmetry and an axis of symmetry of the at least one fluid bag.

4. The unit as claimed in claim 2, wherein the at least one predetermined fold location is at least partially a sealing seam.

5. The unit as claimed in claim 1, further comprising:

a fixing element that fixes the film in the area of the at least one bottom recess at least partially on the lid element.

6. The unit as claimed in claim 1, further comprising:

at least one collection chamber formed in at least one of the lid element and the bottom element that collects the fluid when the at least one closure seam opens.

7. The unit as claimed in claim 6, further comprising:

at least one channel formed in at least one of the lid element and the bottom element that fluidically connects the at least one bottom recess and the at least one collection chamber to each other.

8. The unit as claimed in claim 7, wherein the at least one collection chamber has an outlet that conveys the fluid between the at least one collection chamber and the analysis device.

9. The unit as claimed in claim 1, wherein:

the force introduction surface comprises a stabilizing element, and the film is pressed against the stabilizing element when the pressure is conveyed into the at least one bottom recess.

10. The unit as claimed in claim 1, further comprising:

at least one further fluid bag with a further force introduction surface via which a further force is introduced into the at least one further fluid bag, wherein the at least one further fluid bag is arranged folded in the at least one bottom recess and/or is arranged in the at least one bottom recess in such a way that, in the rest state of the film, the further force introduction surface and the main plane of extent of the film are oriented in different directions, wherein the film pressed against the further force introduction surface by a pressure when said pressure is conveyed into the at least one bottom recess, so as to introduce the further force into the at least one further fluid bag, and wherein the at least one further fluid bag has at least one further closure seam that opens when the further force is introduced.

11. The unit as claimed in claim 10, wherein the force introduction surface and the further force introduction surface are each arranged at an acute angle to the main plane of extent of the film.

12. The unit as claimed in claim 10, wherein the force introduction surface and the further force introduction surface are each arranged at a right angle to the main plane of extent of the film.

13. The unit as claimed in claim 10, wherein:

the force introduction surface and the further force introduction surface are arranged lying opposite each other.

14. The unit as claimed in claim 13, wherein the force introduction surface and the further force introduction surface are each arranged at an acute angle to the main plane of extent of the film.

15. The unit as claimed in claim 13, wherein the force introduction surface and the further force introduction surface are each arranged at a right angle to the main plane of extent of the film.

16. A method for producing a unit as claimed in claim 1, the method comprising:

making available the lid element, the bottom element with at least one bottom recess, the film, and the at least one fluid bag with the force introduction surface via which the force is introduced into the at least one fluid bag; and forming a composite of the lid element, the bottom element, the film and the at least one fluid bag, wherein the at least one bottom recess is arranged lying opposite the lid element, wherein the film, at least in an area of the at least one bottom recess, is arranged between the lid element and the bottom element, wherein the at least one fluid bag is arranged folded in the at least one bottom recess and/or is arranged in the at least one bottom recess in such a way that, in a rest state of the film, the force introduction surface and a main plane of extent of the film are oriented in different directions, wherein the film is pressed against the force introduction surface by a pressure when said pressure is conveyed into the at least one bottom recess, so as to introduce the force into the at least one fluid bag, and wherein the at least one fluid bag has at least one closure seam that opens when the force is introduced.

17. The method as claimed in claim 16, wherein the method is performed by a device.

18. The method as claimed in claim 16, wherein the method is performed by a processor executing a computer program.

19. The method as claimed in claim 18, wherein the computer program is stored on a non-transitory machine-readable storage medium.

* * * * *